US008020495B2

(12) United States Patent
Müller et al.

(10) Patent No.: US 8,020,495 B2
(45) Date of Patent: Sep. 20, 2011

(54) VEHICLE COMPRISING A PITCH JOINT

(75) Inventors: Bernd Müller, Bautzen (DE); Harald Hentschel, Haselbachtal (DE)

(73) Assignee: Bombardier Transportation GmbH, Berlin (DE)

( * ) Notice: Subject to any disclaimer, the term of this patent is extended or adjusted under 35 U.S.C. 154(b) by 344 days.

(21) Appl. No.: 12/088,587

(22) PCT Filed: Sep. 29, 2006

(86) PCT No.: PCT/EP2006/066907
§ 371 (c)(1),
(2), (4) Date: Sep. 2, 2008

(87) PCT Pub. No.: WO2007/039570
PCT Pub. Date: Apr. 12, 2007

(65) Prior Publication Data

US 2009/0178993 A1 Jul. 16, 2009

(30) Foreign Application Priority Data

Oct. 1, 2005 (DE) ..... 10 2005 047 903

(51) Int. Cl.
*B62D 13/00* (2006.01)

(52) U.S. Cl. ..... 105/3; 280/400

(58) Field of Classification Search ..... 105/3, 4.1, 105/4.2, 4.4, 164, 166, 167, 168; 280/400, 280/403, 401, 402, 408, 406.1, 411.1, 419, 280/432
See application file for complete search history.

(56) References Cited

U.S. PATENT DOCUMENTS

| | | | | |
|---|---|---|---|---|
| 3,787,068 | A | 1/1974 | Miller | |
| 4,421,339 | A | 12/1983 | Hagin | |
| 4,482,165 | A * | 11/1984 | Dawson et al. | 280/432 |
| 6,722,685 | B2 | 4/2004 | Koch et al. | |
| 7,338,060 | B2 * | 3/2008 | Koch et al. | 280/403 |

FOREIGN PATENT DOCUMENTS

| | | | |
|---|---|---|---|
| DE | 3030015 | A1 | 4/1982 |
| EP | 1245468 | A1 | 10/2002 |
| FR | 2 562 859 | * | 10/1985 |

* cited by examiner

*Primary Examiner* — Mark T Le
(74) *Attorney, Agent, or Firm* — The Webb Law Firm

(57) ABSTRACT

A vehicle includes a longitudinal axis, a first superstructure, a second superstructure that adjoins the first superstructure in the direction of the longitudinal axis of the vehicle, and a pitch joint that connects the first superstructure and the second superstructure. The pitch joint is embodied as a rod assembly, which extends substantially on one pitch joint plane and comprises two pitch joint arms, two pitch joint rods, and a coupling device. The pitch joint arms are pivotally hinged to the first superstructure in the region of their first end, each of the pitch joint rods is pivotally hinged to the free second end of one of the pitch joint arms in the region of its first end, the pitch joint rods are pivotally hinged to the second superstructure in the region of their second end, and the coupling device couples the two pitch joint such that they perform swiveling movements in opposite directions about their hinged points.

16 Claims, 3 Drawing Sheets

VEHICLE COMPRISING A PITCH JOINT

BACKGROUND OF THE INVENTION

1. Field of the Invention

The current invention relates to a vehicle, particularly a railway vehicle, comprising a longitudinal axis, a first superstructure, a second superstructure that adjoins the first superstructure in the direction of the longitudinal axis of the vehicle, and a pitch joint, which connects the first superstructure and the second superstructure. It also relates to a corresponding pitch joint for an inventive vehicle.

2. Description of Related Art

In the case of railway vehicles, but also with other vehicles, pitch joints are used if wagon parts, for example vehicle bodies (superstructures), are connected by means of floating joints on a multiple-unit articulated train and, when traveling over rises or troughs, a pitch possibility is necessary on this articulated connection, i.e., the possibility of swiveling around a transverse axis of the vehicle that normally runs essentially horizontal.

In the area of the undercarriage, the wagon parts are normally connected by a lower joint. This lower joint typically permits the following relative movements of the wagon parts within certain limits: rotation around a vertical axis of the vehicle (Z axis), commonly called pivoting, and rotation around a transverse axis of the vehicle (Y axis), commonly called pitching. Depending of the type of this lower joint, rotation around the vehicle longitudinal axis (X axis), commonly called rolling, can also be permitted, if necessary.

When traveling into a curve, the individual wagon parts experience different roll positions within a multiple-unit vehicle. Depending upon the design of lower joint, these cause great side sway between the individual wagon parts or high torsional stress to the lower bearings. For this reason, the wagon parts are mutually supported in the region of the roof structure by an additional transverse connection, which is also designated as a roll support among other things. In this case, it is typically a transverse control arm or a sliding block guide coupled to both wagon parts and extending in the transverse direction of the vehicle.

However, there are a series of disadvantages with these solutions. When traveling on curves, with the normally off-center positioning of the transverse control arm, the inside-curve bearing approaches the adjacent wagon part so that, in the case of tight curves, it is possible for the wagon parts to intersect, i.e., collide. In just the same way, when there is a rigid control arm and during travel over rises or troughs, the distance between the outside bearings and the vertical axis of the vehicle (Z axis) changes thereby producing forced twisting of the superstructures. The disadvantage of the normal sliding block guides is that the sliding block approaches the adjacent wagon part during travel over rises and troughs As a result, the wagon parts may intersect, i.e., collide, when there are changes of gradient.

SUMMARY OF THE INVENTION

The present invention is based on the objective of making available a vehicle of the type cited at the outset that does not have the aforementioned disadvantages or at least has them to a considerably lower degree and in particular facilitates a reduction of forced twisting of the superstructures when traveling over rises or troughs in a simple and reliable manner.

The present invention is based on the technical teachings that a reduction of the forced twisting of the superstructures during travel over rises or troughs is rendered possible in a simple and reliable manner. The present invention provides a vehicle comprising a longitudinal, axis, a first superstructure, a second superstructure adjoining the first superstructure in the direction of the longitudinal axis of the vehicle, and a pitch joint connecting the first superstructure and the second superstructure. The pitch joint is embodied as a rod assembly which extends substantially on one pitch joint plane and comprises two pitch joint arms, two pitch joint rods, and a coupling device. The pitch joint arms are pivotally hinged to the first superstructure in the region of their first end, each of the pitch joint rods is pivotally hinged to the free second end of one of the pitch joint arms in the region of its first end, the pitch joint rods are pivotally hinged to the second superstructure in the region of their second end, and the coupling device couples the two pitch joint arms to each other in such a manner that the two pitch joint arms perform swiveling movements in opposite directions about their hinged points on the first superstructure.

By coupling the pitch joint arms in opposite directions, parallel guidance of the two superstructures along the longitudinal axis of the vehicle can be achieved in the case of pitching movements between the superstructures. The advantage of this is that the hinged points of the pitch joint on the superstructures shift towards one another parallel to the longitudinal axis of the vehicle when traveling over rises or troughs or in the case of pitching movements that are otherwise induced between the superstructures. Consequently, in this case, transverse displacements do not occur between the hinged points of the pitch joint on the one superstructure and the hinged points of the pitch joint on the other superstructure. Another advantage of the forced coupling of the pitch joint arms is that the full extent of the roll support effect can be realized.

Depending upon the selected geometric configuration of the pitch joint arms and the pitch joint rods, any transmission between the movements of the pitch joint arms can be provided. However, it is preferred that the coupling device couple the two pitch joint arms with one another in such a way that they perform essentially synchronous swiveling movements about their hinged points on the first superstructure. This allows advantageously simple and symmetrical arrangements to be realized.

The coupling of the pitch joint arms can be accomplished via a gear mechanism of any design, which generates the swiveling movements in opposite directions. In this case, it may be a frictional and/or positive locking and/or a hydraulic gear mechanism, etc. In addition, a continuously variable transmission or the like may also be used for example. However, the coupling device preferably comprises a coupling rod that is pivotally hinged on the respective pitch joint arm or a gearing that couples the pitch joint arms, since it permits especially simple and reliable designs.

The pitch joint can basically be arranged in any suitable alignment. The pitch joint plane preferably runs essentially parallel to a transverse axis of the vehicle, because this allows especially uniform relative strength to be achieved in supporting the roll movements. The pitch joint plane preferably runs essentially perpendicular to a vertical axis of the vehicle, because forces to be absorbed in operation then essentially act in the plane of the rod assembly, in which favorable load conditions can be achieved therewith in the pitch joint arms and the pitch joint rods as well as in the articulation points of the pitch joint.

The pitch joint arms and the pitch joint rods can basically be arranged in any suitable manner. Thus, they can be arranged in an essentially rhomboid manner for example. In addition, the pitch joint arms can be coupled apart from one another on the first superstructure. In advantageous variations of the invention, the pitch joint arms cross between their first end and their second end, thereby resulting in a particularly compact arrangement.

The pitch joint rods can also be arranged in any suitable manner on the second superstructure. It is preferred that the hinged points of the pitch joint rods be arranged so they adjoin one another on the second superstructure so that, in this case, at least a certain swiveling movability of the pitch joint around the vertical axis of the vehicle is present. The hinged points of the pitch joint rods are preferably arranged on the second superstructure in the direction of a vertical axis of the vehicle so they are essentially aligned with one another so that without further additional measures—such as a correspondingly articulated positioning of a support accommodating the hinged points of the pitch joint rods on the second superstructure—a swiveling movability of the pitch joint around the vertical axis of the vehicle is present.

The first superstructure and the second superstructure are preferably connected pivotally via a further pivot bearing around a first pivot axis that is essentially parallel to the vertical axis of the vehicle, and the hinged points of the pitch joint rods on the second superstructure lie essentially on the first pivot axis. In this way, an additional pivot joint is not required in the region of the pitch joint in order to realize the swiveling movement of the superstructures during travel over curves.

The pitch joint arms can be fastened directly to the first superstructure. However, it is preferred that the pitch joint arms be coupled to pitch joint support, via which they are fastened to the first superstructure. As a result, a certain degree of transverse elasticity, even transverse damping if necessary, can be added to the pitch joint in a simple manner. In preferred variations of the invention, this is accomplished in a simple way by fastening the pitch joint support to the first superstructure via a spring device, wherein the spring device comprises a damper device in particular.

The spring device then preferably facilitates a swiveling movement of the pitch joint support around the vertical axis of the vehicle so that the transverse elasticity can be simply realized in this manner. For this purpose, the spring device preferably comprises two spring elements—in particular rubber-metal spring elements—spaced apart from each other along the transverse axis of the vehicle.

To prevent twisting in the pitch joint during pitching movements, it is preferably provided that at least a portion of the articulated connections of the pitch joint, in particular the articulated connections of the pitch joint rods, permits swiveling movements around the swivel axes lying in the pitch joint plane. For this purpose, at least a portion of the articulated connections of the pitch joint, in particular the articulated connections of the pitch joint rods, is of spherical design.

The present invention also relates to a pitch joint for an inventive vehicle having the features described above in connection with the inventive vehicle.

Additional preferred embodiments of the invention are contained in the following description of the preferred exemplary embodiments, which make reference to the enclosed drawings.

DESCRIPTION OF THE PREFERRED EMBODIMENTS

First Exemplary Embodiment

Figure 1:
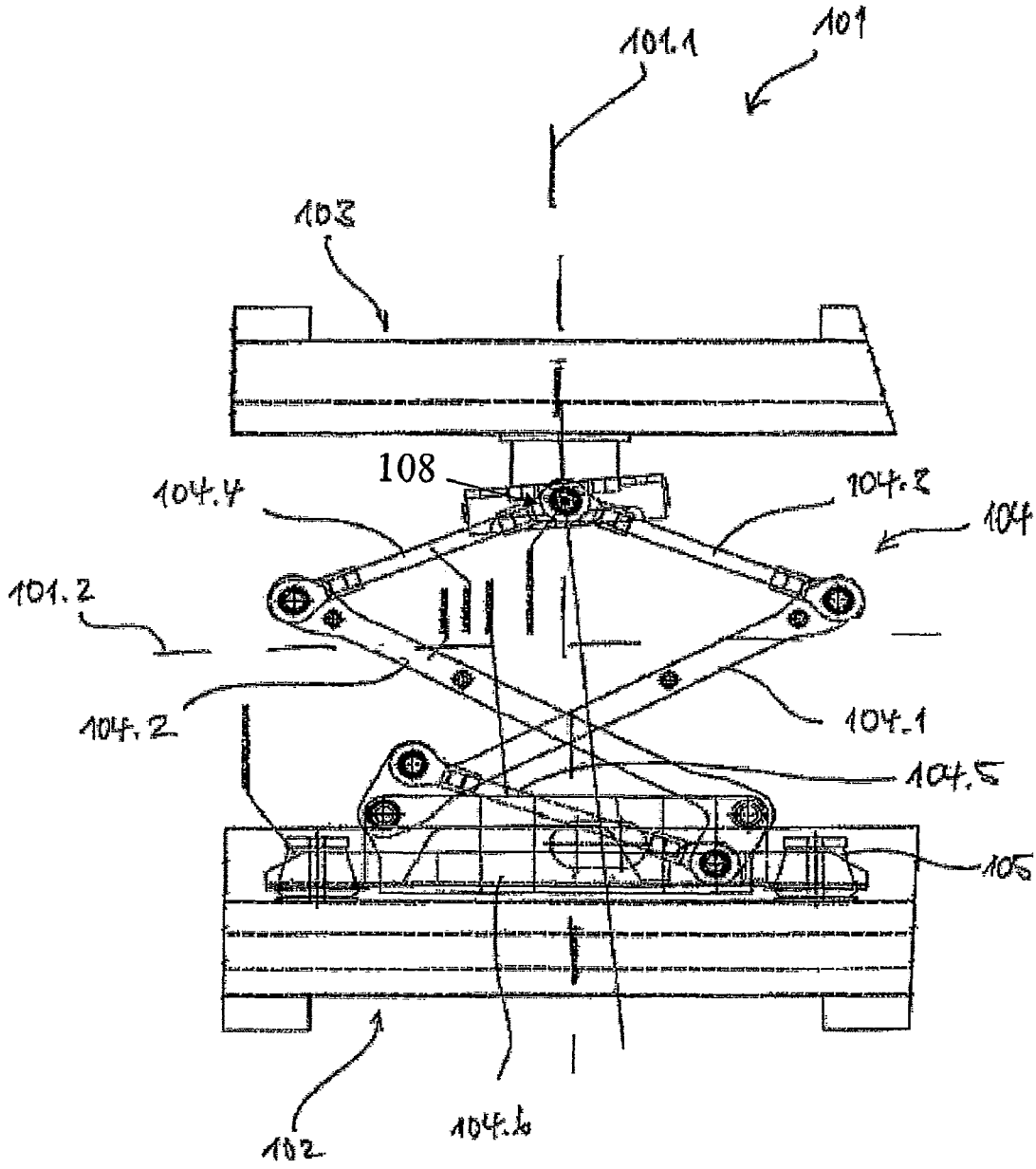
FIG. 1 is a schematic top view of a portion of a vehicle in accordance with one embodiment of the present invention.

FIG. 1 depicts a schematic top view of a portion of an inventive vehicle in the form of an articulated train 101 with a longitudinal axis 101.1 of the vehicle and a transverse axis 101.2 of the vehicle. The vehicle 101 comprises a first superstructure 102 and a second superstructure 103.

The superstructures 102 and 103 are connected in their roof regions via a pitch joint 104, while in their base regions, where they are supported on undercarriages (not shown), they are pivotally connected via a pivot joint (also not shown) around a vertical axis of the vehicle that runs perpendicular to the drawing plane.

The first superstructure 102 and the second superstructure 103 are preferably connected pivotally via a further pivot bearing 108 around a first pivot axis that is essentially parallel to the vertical axis of the vehicle 101, and the hinged points of pitch joint rods on the second superstructure 103 lie essentially on the first pivot axis.

The pitch joint 104 is embodied as a rod assembly that extends in a pitch joint plane essentially parallel to the drawing plane. It comprises two pitch joint arms 104.1 and 104.2 crossing each other between their ends, two pitch joint rods 104.3 and 104.4 as well as a coupling device in the form of a coupling rod 104.5.

The pitch joint arms 104.1 and 104.2 feature essentially the same effective length, i.e., the essentially same distance between their respective pivot points, and, in the region of their first end, are pivotally hinged on a pitch joint support 104.6, which, in turn, is fastened elastically to the first superstructure 102 via rubber-metal spring elements 105 having a damper 106.

The first pitch joint rod 104.3 is pivotally hinged in the region of its first end on the free second end of the first pitch joint arm 104.1, while the second pitch joint rod 104.4 is pivotally hinged in the region of its first end on the free second end of the second pitch joint arm 104.2. The pitch joint rods 104.3 and 104.4 also have essentially the same effective length.

The pitch joint rods 104.3 and 104.4 are pivotally hinged on the second superstructure 103 in the region of their second ends. In this case, the hinged points of the pitch joint rods 104.3 and 104.4 on the second superstructure 103 are arranged adjacent to one another in such a way that they essentially align with one another in the direction of a vertical axis of the vehicle 101. This results in a swiveling movability of the pitch joint 104 around the vertical axis of the vehicle without any additional measures.

The hinged points of the pitch joint rods 104.3 and 104.4 on the second superstructure 103 lie on the pivot axis, which is defined by the lower pivot joint (not shown) between the first superstructure 102 and the second superstructure 103. Consequently, the first superstructure 102 and the second superstructure 103 are pivotally connected by the lower pivot joint and the pitch joint 104 around a vertical axis of the vehicle that runs perpendicular to the drawing plane.

The advantage of this arrangement of the hinged points of the pitch joint rods 104.3 and 104.4 on the second superstructure 103, among other things, is that an additional pivot joint is not required in the region of the pitch joint to realize the swiveling movement of the superstructures during travel over curves. It is understood, however, that in the case of other variations of the invention another linking of the pitch point rods, particularly one that is spaced apart in the pitch joint plane, may by all means be provided, wherein, if necessary, the swiveling movability around the vertical axis of the vehicle is then realized via an additional pivot joint.

The coupling rod 104.5 is pivotally hinged on the pitch joint arms 104.1 and 104.2 and couples the two pitch joint arms 104.1 and 104.2 with one another in such a manner that they execute essentially synchronous swiveling movements in opposite directions around their hinged points on the first superstructure 102.

By coupling of the pitch joint arms 104.1 and 104.2 in opposite directions, parallel guidance of the two superstructures 102 and 103 along the longitudinal axis 101.1 of the vehicle can be achieved in the case of pitching movements between the superstructures. The advantage of this is that the hinged points of the pitch joint 104 on the superstructures shift towards one another parallel to the longitudinal axis 101.1 of the vehicle during travel over rises or troughs or in the case of pitching movements that are otherwise induced between the superstructures. Consequently, in this case, transverse displacements do not occur along the transverse axis 101.2 of the vehicle between the hinged points of the pitch joint 104 on the first superstructure 102 and the hinged points of the pitch joint 104 on the second superstructure 103.

This assures in a simple and reliable manner that essentially no forced twisting of the superstructures 102 and 103 occurs during travel over rises or troughs. Another advantage of the forced coupling of the pitch joint arms 104.1 and 104.2 is that the full extent of the roll support effect can be realized.

The synchronous coupling in opposite directions of the pitch joint arms 104.1 and 104.2 is achieved by the coupling rod 104.5 being coupled in such a way on projections of the pitch joint arms 104.1 and 104.2 that the straight connecting line of their hinged points on the pitch joint arms 104.1 and 104.2 intersects essentially the center of the straight connecting line of the hinged points of the pitch joint arms 104.1 and 104.2 on the pitch joint support 104.6.

The pitch joint plane of the pitch joint 104 runs essentially perpendicular to the vertical axis of the vehicle 101 so that the forces to be absorbed in operation essentially act in the plane of the rod assembly formed by the pitch joint 104. Consequently, favorable load conditions are achieved in the pitch joint arms 104.1 and 104.2 and the pitch joint rods 104.3 and 104.4 as well as the pivot points of the pitch joint 104.

Because of the crossing arrangement of the pitch joint arms 104.1 and 104.2 an especially compact arrangement is additionally achieved so that the adjacent construction space is available for other components and moreover no collisions are to be expected even in the case of tight curve radii.

The advantage of the arrangement of the pitch joint arms 104.1 and 104.2 on the elastically positioned pitch joint support 104.6 via the rubber-metal spring elements 105 is that a certain transverse elasticity and transverse damping are hereby added to the pitch joint 104 in a simple manner. The rubber-metal spring elements 105 (e.g., a Megi® cone, respectively) that are spaced apart in the direction of the transverse axis 101.2 of the vehicle make possible a transverse movement of the pitch joint support 104.6 in the direction of the transverse axis 101.2 of the vehicle as well as a rotational movement of the pitch joint support 104.6 around the vertical axis of the vehicle. This facilitates slight, damped roll deflections between the superstructures 102 and 103.

The pitch joint arms 104.1 and 104.2 are coupled to the pitch joint support 104.6 in simple pivot bearings. To prevent twisting in the pitch joint 104 during pitching movements, the articulated connections of the pitch joint rods 104.3 and 104.4 are designed as spherical joints, which permit swiveling movements around the pivot axes lying in the pitch joint plane.

Since they have to transmit only tensile and/or compressive forces, the pitch joint rods 104.3 and 104.4 as well as the coupling rod 104.5 are designed as comparatively light rod elements. To facilitate an adjustment of the pitch joint 104, the pitch joint rods 104.3 and 104.4 as well as the coupling rod 104.5 are designed to be adjustable in length.

Second Exemplary Embodiment

Figure 2:
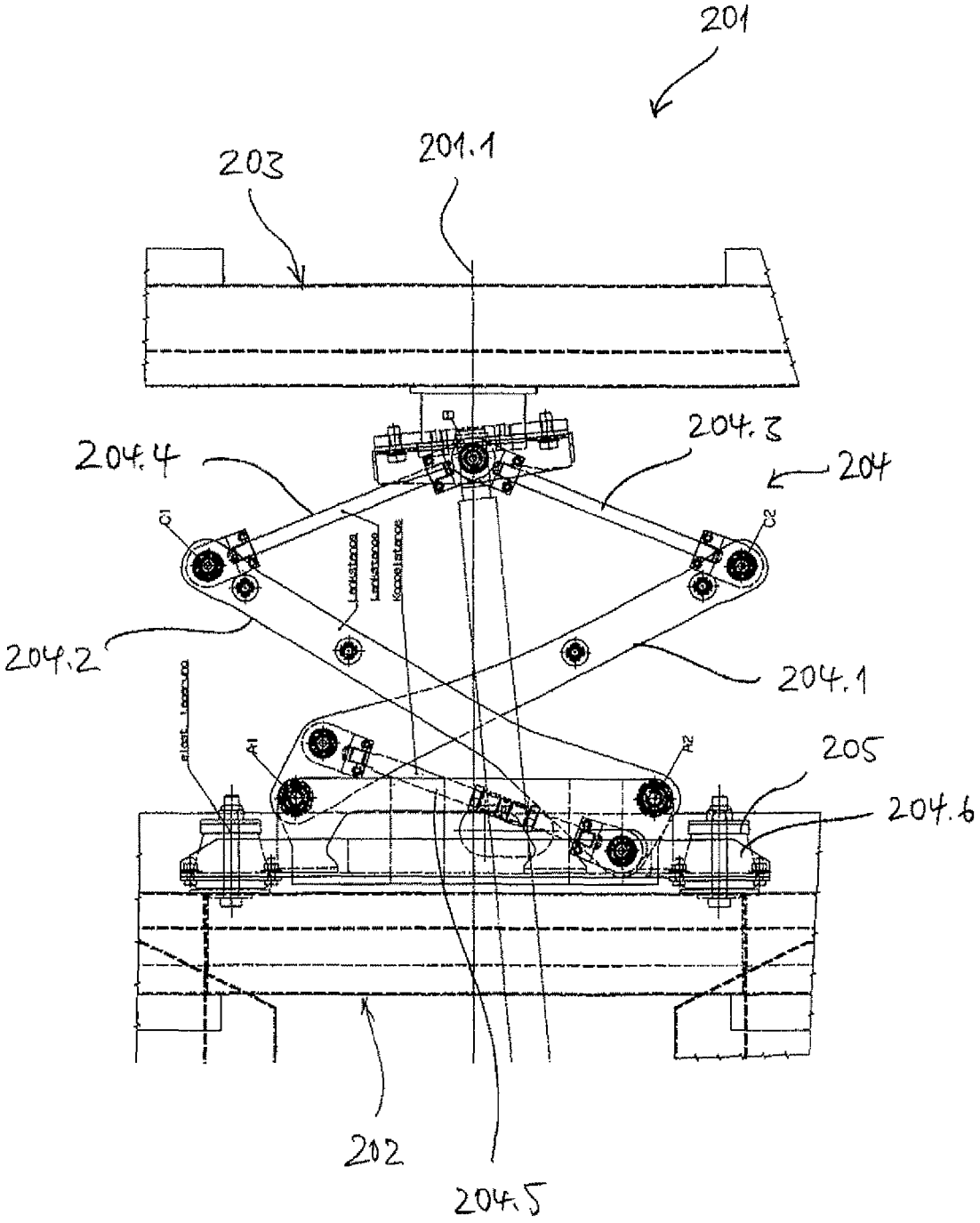
FIG. 2 is a schematic top view of a portion of a vehicle in accordance with another embodiment of the present invention.

FIG. 2 shows a schematic top view of a portion of another inventive vehicle 201. Because the vehicle 201 largely corresponds in terms of its structure and function to the vehicle 101 from FIG. 1, only the differences shall be discussed here. In particular, in FIG. 2 the same components as the embodiment in FIG. 1 are provided with reference numbers that have been increased by 100, and reference is made to the foregoing statements with respect to their function and design.

The essential difference from the embodiment shown in FIG. 1 consists merely of the design of the pitch joint arms 204.1 and 204.2. Those in FIG. 2 are more sturdily designed and are provided with a cross-sectional progression that is adapted to the progression of the bending moment.

Third Exemplary Embodiment

Figure 3:
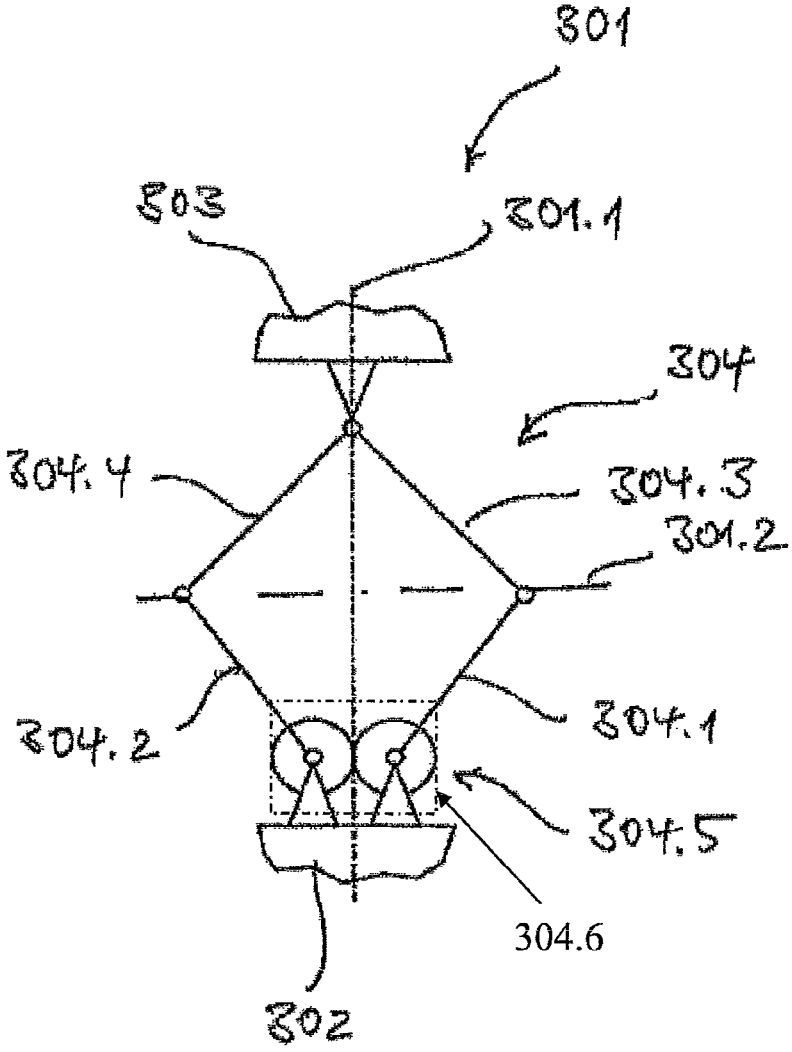
FIG. 3 A schematic top view of a portion of another preferred embodiment of the inventive vehicle.

FIG. 3 shows a schematic top view of a portion of another inventive vehicle 301 with a longitudinal axis 301.1 of the vehicle and a transverse axis 301.2 of the vehicle. The vehicle 301 basically corresponds in terms of structure and function to the vehicle 101 from FIG. 17 so that only the differences shall be discussed here. In particular, in FIG. 3 the same components as the embodiment in FIG. 1 are provided with reference numbers that have been increased by 200 and reference is made to the foregoing statements with respect to their function and design.

The vehicle 301 comprises a first superstructure 302 and a second superstructure 303. The superstructures 302 and 303 are connected in their roof regions via a pitch joint 304, while in their base regions, where they are supported on undercarriages (not shown), they are pivotally connected via a pivot joint (also not shown) around a vertical axis of the vehicle that runs perpendicular to the drawing plane.

The pitch joint 304 is embodied as a rhomboid rod assembly that extends in a pitch joint plane essentially parallel to the drawing plane. It comprises two pitch joint arms 304.1 and 304.2, two pitch joint rods 304.3 and 304.4 as well as a coupling device in the form of a gearwheel pair 304.5 with the transmission ratio of 1. The coupling device may also be a gearing 304.6 (FIG. 3 showing the gearing represented by a box diagram in dashed lines) in the form of either a frictional connection, a positive locking connection, a continuously variable transmission, or a hydraulic gear mechanism.

The pitch joint arms 304.1 and 304.2 feature essentially the same effective length, i.e., the essentially same distance between their respective pivot points, and are pivotally fastened to the first superstructure 302 in the region of their first end.

The first pitch joint rod 304.3 is pivotally hinged in the region of its first end on the free second end of the first pitch joint arm 304.1, while the second pitch joint rod 304.4 is pivotally hinged in the region of its first end on the free second end of the second pitch joint arm 304.2. The pitch joint rods 304.3 and 304.4 also have essentially the same effective length.

The pitch joint rods 304.3 and 304.4 are pivotally hinged in the region of their second ends on the second superstructure 303. In this case, the hinged points of the pitch joint rods 304.3 and 304.4 on the second superstructure 303 are arranged adjacent to one another in such a way that they essentially align with one another in the direction of a vertical axis of the vehicle 301. This results in swiveling movability of the pitch joint 304 around the vertical axis of the vehicle without any additional measures.

The hinged points of the pitch joint rods 304.3 and 304.4 on the second superstructure 303 lie on the pivot axis, which is defined by the lower pivot joint (not shown) between the first superstructure 302 and the second superstructure 303. Consequently, the first superstructure 302 and the second superstructure 303 are pivotally connected by the lower pivot joint and the pitch joint 304 around a vertical axis of the vehicle that runs perpendicular to the drawing plane.

One of the advantages of this arrangement of the hinged points of the pitch joint rods 304.3 and 304.4 on the second superstructure 303 is that an additional pivot joint is not required in the region of the pitch joint to realize the swiveling movement of the superstructures during travel over curves. It is understood, however, that in the case of other variations of the invention another linking of the pitch point rods, in particular, one that is spaced apart in the pitch joint plane, may be provided by all means, wherein, if necessary, the swiveling movability around the vertical axis of the vehicle is then realized via an additional pivot joint.

The gearwheel pair 304.5 comprises two gearwheels, which are each connected in a rotationally secured manner with one of the pitch joint arms 304.1 and 304.2. The gearwheel pair 304.5 couples the two pitch joint arms 304.1 and 304.2 with one another in such a manner that they execute essentially synchronous swiveling movements in opposite direction around their hinged points on the first superstructure 302.

By coupling the pitch joint arms 304.1 and 304.2 in opposite directions, parallel guidance of the two superstructures 302 and 303 along the longitudinal axis 301.1 of the vehicle can be achieved in the case of pitching movements between the superstructures. The advantage of this is that the hinged points of the pitch joint 304 on the superstructures shift towards one another parallel to the longitudinal axis 301.1 of the vehicle during travel over rises or troughs or in the case of pitching movements that are otherwise induced between the superstructures. Consequently, in this case, transverse displacements do not occur along the transverse axis 301.2 of the vehicle between the hinged points of the pitch joint 304 on the first superstructure 302 and the hinged points of the pitch joint 304 on the second superstructure 303.

This assures in a simple and reliable manner that essentially no forced twisting of the superstructures 302 and 303 occurs during travel over rises or troughs. Another advantage of the forced coupling of the pitch joint arms 304.1 and 304.2 is that the full extent of the roll support effect can be realized.

The pitch joint plane of the pitch joint 304 runs essentially perpendicular to the vertical axis of the vehicle 301 so that the forces to be absorbed in operation essentially act in the plane of the rod assembly formed by the pitch joint 304. Consequently, favorable load conditions are achieved in the pitch joint arms 304.1 and 304.2 and the pitch joint rods 304.3 and 304.4 as well as the pivot points of the pitch joint 304.

The pitch joint arms 304.1 and 304.2 are coupled to the pitch joint support 304.6 in simple pivot bearings. To prevent twisting in the pitch joint 304 during pitching movements, the articulated connections of the pitch joint rods 304.3 and 304.4 are designed as spherical joints, which permit swiveling movements around the pivot axes lying in the pitch joint plane.

Since they have to transmit only tensile and/or compressive forces, the pitch joint rods 304.3 and 304.4 are designed as comparatively light rod elements. To make an adjustment of the pitch joint 304 possible, the pitch joint rods 304.3 and 304.4 are designed to be adjustable in length.

The present invention was described in above exclusively on the basis of examples for railway vehicles. However, it is ultimately understood that the invention may also be used in connection with any other vehicles.

The invention claimed is:

1. A vehicle, comprising:

a longitudinal axis, a first superstructure, a second superstructure, which adjoins the first superstructure in the direction of the longitudinal axis of the vehicle, and a pitch joint, which connects the first superstructure and the second superstructure, wherein the pitch joint is embodied as a rod assembly, the pitch joint extending substantially on one pitch joint plane and comprising two pitch joint arms, two pitch joint rods, and a coupling device, wherein the pitch joint arms are pivotally hinged to the first superstructure in the region of a first end of the pitch joint arms, each of the pitch joint rods is pivotally hinged to a second end of one of the pitch joint arms in the region of a first end of the pitch joint rods, the pitch joint rods are pivotally hinged to the second superstructure in the region of a second end of the pitch joint rods, and the coupling device couples the two pitch joint arms to each other in such a manner that the two pitch joint arms perform swiveling movements in opposite directions about their hinged points on the first superstructure, wherein the first superstructure and the second superstructure are pivotally connected via a further pivot bearing around a first pivot axis that is essentially parallel to a vertical axis of the vehicle, and hinged points of the pitch joint rods on the second superstructure lie essentially on the first pivot axis.

2. The vehicle according to claim 1, wherein the coupling device couples the two pitch joint arms with one another in such a way that they perform essentially synchronous swiveling movements about their hinged points on the first superstructure.

3. The vehicle according to claim 1, wherein the coupling device comprises a coupling rod that is pivotally hinged on the respective pitch joint arm or a gearing that couples the pitch joint arms.

4. The vehicle according to claim 3, wherein the gearing is one of a frictional connection, a positive locking connection, a continuously variable transmission, and a hydraulic gear mechanism.

5. The vehicle according to claim 1, wherein the pitch joint plane runs essentially parallel to a transverse axis of the vehicle.

6. The vehicle according to claim 1, wherein the pitch joint plane runs essentially perpendicular to a vertical axis of the vehicle.

7. The vehicle according to claim 1, wherein the pitch joint arms are coupled apart from one another on the first superstructure.

8. The vehicle according to claim 1, wherein the pitch joint arms cross between their first ends and their second ends.

9. The vehicle according to claim 1, wherein the hinged points of the pitch joint rods are arranged to adjoin one another on the second superstructure.

10. The vehicle according to claim 1, wherein the hinged points of the pitch joint rods are arranged on the second superstructure in a direction of the vertical axis of the vehicle such that the hinged points are essentially aligned with one another.

11. The vehicle according to claim 1, wherein the pitch joint arms are fastened to the first superstructure via a pitch joint support.

12. The vehicle according to claim 11, wherein the pitch joint support is fastened to the first superstructure via a spring device, wherein the spring device comprises a damper device.

13. The vehicle according to claim 12, wherein the spring device facilitates a swiveling movement of the pitch joint support around the vertical axis of the vehicle.

14. The vehicle according to claim 12, wherein the spring device comprises two spring elements spaced apart from each other along the transverse axis of the vehicle.

15. The vehicle according to claim 1, wherein at least a portion of articulated connections of the pitch joint permits swiveling movements around swivel axes lying in the pitch joint plane.

16. The vehicle according to claim 1, wherein at least a portion of articulated connections of the pitch joint is embodied spherically.

* * * * *

UNITED STATES PATENT AND TRADEMARK OFFICE

CERTIFICATE OF CORRECTION

PATENT NO. : 8,020,495 B2
APPLICATION NO. : 12/088587
DATED : September 20, 2011
INVENTOR(S) : Bernd Muller It is certified that error appears in the above-identified patent and that said Letters Patent is hereby corrected as shown below:

Face of the Patent, Item (57), Abstract, Column 2, Line 14, after "joint" insert -- arms --

Signed and Sealed this
Third Day of January, 2012

David J. Kappos

David J. Kappos
*Director of the United States Patent and Trademark Office*